US010668714B2

(12) United States Patent
Zaborowski et al.

(10) Patent No.: US 10,668,714 B2
(45) Date of Patent: Jun. 2, 2020

(54) VARIABLE TENSION AND/OR TRANSPORT SPEED RETRANSFER PRINTING PROCESS

(71) Applicant: ENTRUST DATACARD CORPORATION, Shakopee, MN (US)

(72) Inventors: Alexander K. Zaborowski, Shakopee, MN (US); Craig Berry, Shakopee, MN (US); Rajesh K. Juriasingani, Shakopee, MN (US)

(73) Assignee: ENTRUST DATACARD CORPORATION, Shakopee, MN (US)

( * ) Notice: Subject to any disclaimer, the term of this patent is extended or adjusted under 35 U.S.C. 154(b) by 219 days.

(21) Appl. No.: 15/801,974

(22) Filed: Nov. 2, 2017

(65) Prior Publication Data

US 2018/0117904 A1 May 3, 2018

Related U.S. Application Data

(60) Provisional application No. 62/416,453, filed on Nov. 2, 2016.

(51) Int. Cl.

| | |
|---|---|
| ***B41F 16/00*** | (2006.01) |
| ***B42D 25/46*** | (2014.01) |
| ***B42D 25/47*** | (2014.01) |
| ***B42D 25/455*** | (2014.01) |
| *B42D 25/20* | (2014.01) |
| *B42D 25/23* | (2014.01) |
| *B42D 25/24* | (2014.01) |

(52) U.S. Cl.

CPC ..... *B41F 16/002* (2013.01); *B41F 16/006* (2013.01); *B41F 16/0026* (2013.01); *B42D 25/455* (2014.10); *B42D 25/46* (2014.10); *B42D 25/47* (2014.10); *B42D 25/23* (2014.10); *B42D 25/24* (2014.10); *B42D 25/285* (2014.10)

(58) Field of Classification Search

CPC ..... B41F 16/0026
USPC ..... 400/194
See application file for complete search history.

(56) References Cited

U.S. PATENT DOCUMENTS 6,030,474 A * 2/2000 Isono ..... B29C 63/02 156/238
6,261,012 B1 * 7/2001 Haas ..... B41J 2/325 156/265
6,478,488 B1 * 11/2002 Engel ..... B65C 11/02 400/611

(Continued)

FOREIGN PATENT DOCUMENTS

JP 2016157369 A 9/2016
WO 2016164699 A1 10/2016

OTHER PUBLICATIONS

International Search Report and Written Opinion issued in PCT/US2017/059694 dated May 18, 2018, 9 pages.

*Primary Examiner* — Anthony H Nguyen
(74) *Attorney, Agent, or Firm* — Hamre, Schumann, Mueller & Larson, P.C.

(57) ABSTRACT

Retransfer printing methods and systems are described where a variable stripping process is utilized while stripping all or a portion of the retransfer film (also known as intermediate transfer media) from the surface of a substrate. The variable stripping process includes stripping the retransfer film from different sections of the substrate surface while applying different tensions to the retransfer film and/or at different transport speeds of the retransfer film and the substrate.

18 Claims, 6 Drawing Sheets

(56) References Cited

U.S. PATENT DOCUMENTS

| | | | | |
|---|---|---|---|---|
| 6,554,044 | B2 | 4/2003 | Paulson et al. | |
| 6,762,780 | B2 | 7/2004 | Tsuruta et al. | |
| 8,654,164 | B2 | 2/2014 | Mochizuki et al. | |
| 9,427,993 | B2 * | 8/2016 | Rieck | B41J 25/312 |
| 10,486,455 | B2 * | 11/2019 | Schinabeck | B42D 25/29 |
| 2003/0026635 | A1 * | 2/2003 | Tsuruta | B41J 2/0057 400/82 |
| 2005/0064127 | A1 * | 3/2005 | Turner | B31D 1/0075 428/40.1 |
| 2006/0196606 | A1 | 9/2006 | Sumida et al. | |
| 2015/0266288 | A1 * | 9/2015 | Bieber | B41F 16/0026 101/27 |
| 2016/0185125 | A1 * | 6/2016 | Aihara | B41J 2/325 347/217 |
| 2016/0236481 | A1 * | 8/2016 | Ihara | B41J 2/325 |
| 2016/0300128 | A1 | 10/2016 | Alvig et al. | |
| 2018/0117905 | A1 | 5/2018 | Zaborowski et al. | |

* cited by examiner

VARIABLE TENSION AND/OR TRANSPORT SPEED RETRANSFER PRINTING PROCESS

FIELD

This disclosure relates to retransfer printing where an image is first printed onto a transfer layer of a retransfer film and the printed image is then transferred onto a surface of a substrate by adhering the transfer layer of the retransfer film to the surface and then stripping a portion of the retransfer film from the surface leaving behind the printed image on the surface.

BACKGROUND

Retransfer printing is a well-known technique for printing a high-quality image on a surface of a substrate including plastic card-shaped substrates. Examples of retransfer printing are described in U.S. Pat. Nos. 6,554,044 and 8,654,164.

SUMMARY

Retransfer printing methods and systems are described herein. A variable stripping process is utilized while stripping all or a portion of the retransfer film (also known as intermediate transfer media) from the surface of a substrate. The variable stripping process includes stripping the retransfer film from different sections of the substrate surface while applying different tensions to the retransfer film and/or at different transport speeds of the retransfer film and the substrate.

In the retransfer process, optimal transfer of the retransfer material (or optimal prevention of transfer of the retransfer material) to one section of the substrate may best be performed while applying one level of tension to the retransfer film and/or while transporting the retransfer film and the substrate at one speed, while optimal transfer of the retransfer material (or optimal prevention of transfer of the retransfer material) to another section of the substrate may best be performed while applying a second, different level of tension to the retransfer film and/or while transporting the retransfer film and the substrate at a second, different speed. Therefore, by utilizing a variable stripping process where the tension applied to the retransfer film during stripping and/or the transport speed of the retransfer film and the substrate are varied over different regions or sections of the substrate surface, improved retransfer printing can be achieved.

The substrates described herein can be any substrates to which one may wish to transfer a printed image from a retransfer film onto a surface of the substrate. In one embodiment, the substrate can be a plastic card or passport page. Examples of plastic cards can include, but are not limited to, financial (e.g., credit, debit, or the like) cards, driver's licenses, national identification cards, business identification cards, gift cards, and other plastic cards which bear personalized data unique to the cardholder and/or which bear other card information.

In one embodiment, a retransfer printing method for transferring a printed image from a retransfer film to a surface of a card includes adhering the retransfer film containing the printed image to the surface of the card, and thereafter stripping all or a portion of the retransfer film from the surface of the card so that the printed image remains on the surface. Stripping the retransfer film includes stripping all or a portion of the retransfer film from a first portion of the surface of the card while a first tension is applied to the retransfer film and/or while transporting the retransfer film and the card at a first speed, and stripping all or a portion of the retransfer film from a second portion of the surface of the card while a second tension is applied to the retransfer film and/or while transporting the retransfer film and the card at a second speed, wherein the first tension differs from the second tension, and the first speed differs from the second speed.

DRAWINGS

Figure 5A:
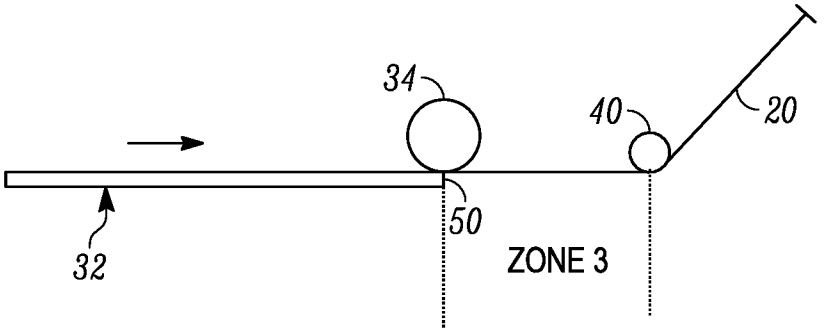
Figure 5B:
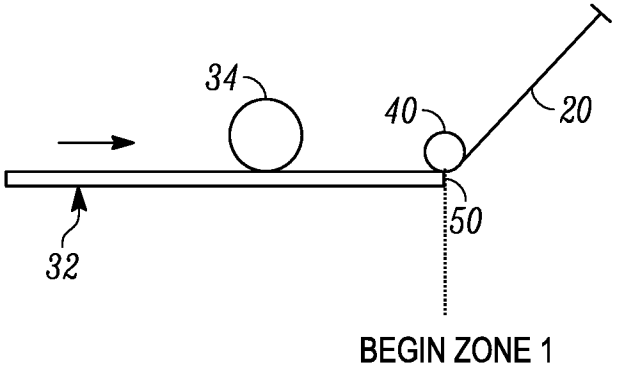
Figure 5C:
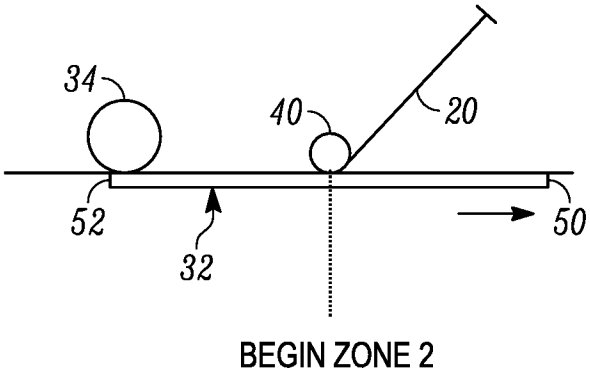

FIGS. 5A-C illustrate an example progression of the plastic card substrate and the retransfer film past the transfer mechanism at the transfer station and past the stripping station.

DETAILED DESCRIPTION

Retransfer printing methods and systems are described where a variable stripping process is utilized while stripping all or a portion of the retransfer film (or intermediate transfer media) from the surface of a substrate. The variable stripping process includes stripping the retransfer film from different sections of the substrate surface while applying different tensions to the retransfer film and/or at different transport speeds of the retransfer film and the substrate. As used in the description and claims, unless indicated otherwise, stripping the retransfer film includes and encompasses stripping all layers of the retransfer film (i.e. inhibitor material, discussed further below, is present which prevents transfer of any layers of the retransfer film to the substrate) and includes stripping a portion of the retransfer film (i.e. at least one layer of the retransfer film remains on the substrate after stripping, while the remainder of the retransfer film is not transferred to the substrate).

The retransfer printing methods and systems described herein can be applied to retransfer printing on any substrate that may benefit from the variable stripping process described herein. However, for sake of convenience, the substrate will hereinafter be described as being a plastic card including, but not limited to, financial (e.g., credit, debit, or the like) cards, driver's licenses, national identification cards, business identification cards, gift cards, and other plastic cards which bear personalized data unique to the cardholder and/or which bear other card information.

The retransfer printing is performed by a retransfer printing system. In the case of plastic cards as the substrates, the retransfer printing system may also be referred to as a card personalization machine or card personalization system. The card personalization machine can be a desktop card personalization machine that is designed to personalize cards one at a time, for example on the order of tens or hundreds per hour, or a central issuance system that is designed to simultaneously personalize multiple cards, for example on the order of thousands per hour. A card personalization machine is intended to encompass a machine that personalizes cards as well as passports and other identification documents.

Figure 1:
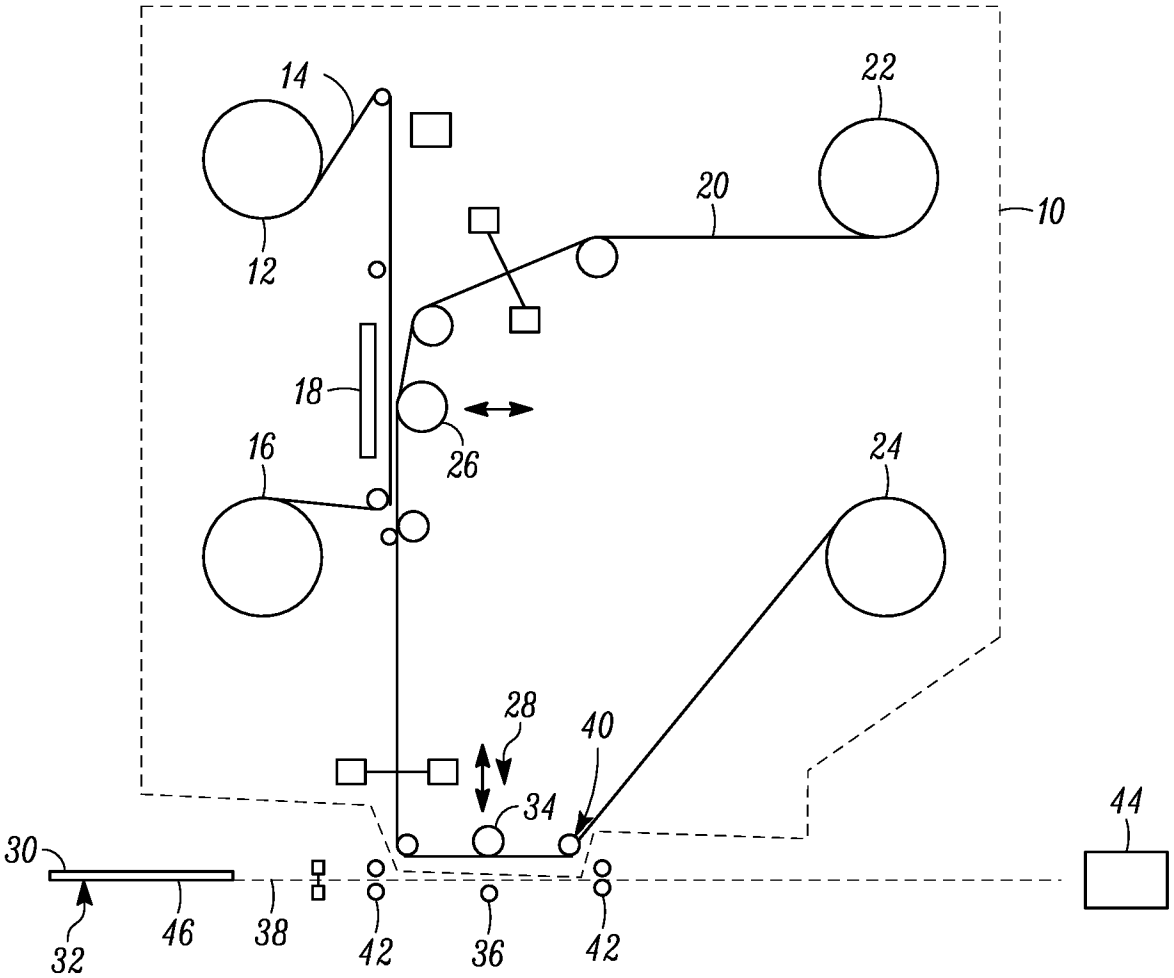
FIG. 1 illustrates a portion of a retransfer printing system that can implement the retransfer printing described herein.

FIG. 1 illustrates an example of the print engine 10 configured for retransfer printing. The print engine 10 is part of a card personalization machine. An example of a card personalization machine that can perform retransfer printing is described in U.S. Published Application No. 2016/0300128 filed on Apr. 8, 2016, which is incorporated herein by reference in its entirety. The specific construction and operation of retransfer printers, including the print ribbon, the retransfer film, printing an image on the retransfer film, and transferring the printed image onto a surface of a card, is well known in the art.

The illustrated retransfer printing configuration of the print engine 10 includes a print side that includes a print ribbon supply 12 from which a supply of monochrome or multi-color print ribbon 14 is supplied, and a print ribbon take-up 16 that takes-up used print ribbon 14. The print ribbon is directed past a print head 18, which in the illustrated example can be stationary, which transfers dye or pigment ink from the print ribbon 14 onto a retransfer film 20. After printing, the used print ribbon 14 is then wound onto the take-up 16.

The retransfer film 20 is supplied from a film supply 22 on a retransfer side, and after retransfer the remaining film is wound onto a film take-up 24 also on the retransfer side. The retransfer film 20 is directed past a platen roller 26 positioned opposite the print head 18 and which in the illustrated example can be moved toward and away from the print head 18 to press the retransfer film 20 and the print ribbon 14 between the print head 18 and the platen roller 26 during printing onto the retransfer film 20. A section of the retransfer film on which the image is to be printed may make a single pass past the print head 18 or multiple passes past the print head 18 in order to print the entire image in which case the travel of the retransfer film 20 may be reversible.

Once a desired image is printed onto the retransfer film 20, the section of the retransfer film 20 with the printed image thereon is advanced to a transfer station 28 where the printed image on the retransfer film 20 is transferred onto a surface 30 of a card 32. In this example, the transfer station 28 includes a heated transfer mechanism 34, for example a transfer roller, that is movable toward and away from a fixed platen 36 positioned on the opposite side of a card travel or transport path 38. The heated transfer mechanism 34 presses the portion of the retransfer film 20 containing the printed image against the surface 30 of the card 32 which is backed by the platen 36, with the retransfer film 20 and the card 32 then being transported together past the heated transfer mechanism 34 to adhere or laminate the layer of the retransfer film 20 containing the printed image onto the card surface 30. The retransfer film 20 and the card 32 are then transported to a stripping station 40 that includes a stripping pin 42 where a portion of the retransfer film 20 is stripped from the card surface 30 leaving behind the printed image on the card surface 30. The remainder of the retransfer film 20, minus the transferred image, is then wound onto the film take-up 24. The card 32 is transported along the card travel path 38 by a card transport mechanism, such as sets of rollers 42.

In some embodiments, discussed further below, an optional card reorienting mechanism 44 (or card flipper 44) can be located downstream of the stripping station 40 in the card travel path 38. The card reorienting mechanism 44 can receive the card 32 after the printed image has been applied to the surface 30, and flip the card 32 over (i.e. flip the card 180 degrees) so that the opposite surface 46 is now facing upward. The card 32 can then be transported back upstream of the transfer station 28 in order to retransfer print a printed image onto the surface 46. In embodiments where printing on the surface 46 is not required, the card reorienting mechanism 44 is not required and can be removed, or the card 32 can be transported through the card reorienting mechanism 44 without flipping the card 32.

Figure 2:
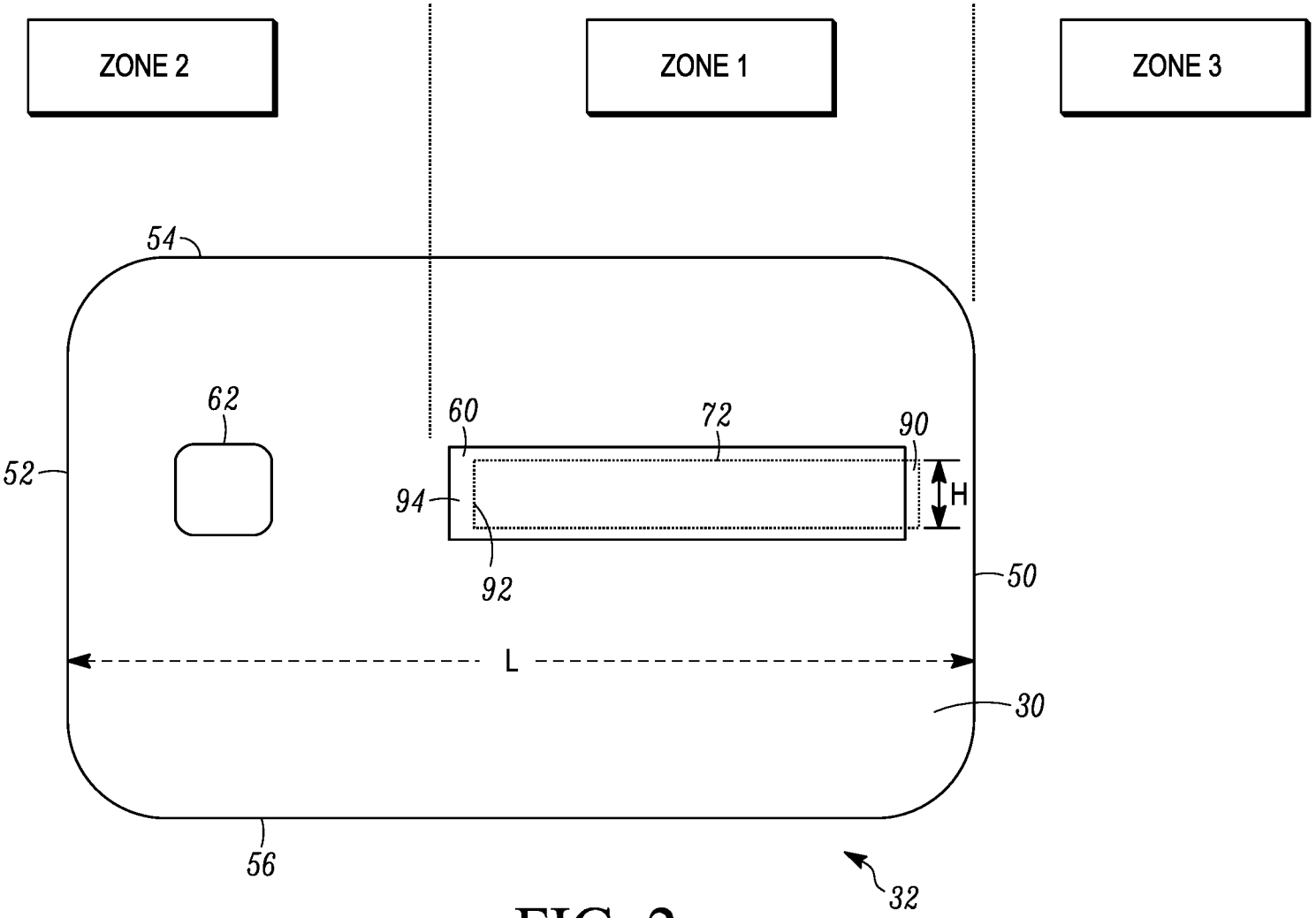
FIG. 2 illustrates the rear surface of a plastic card substrate.

Referring to FIG. 2, an example of the surface 30 of the card 32 is illustrated. The card 32 is generally rectangular in construction with rounded corners. The card 32 includes a leading edge 50 and a trailing edge 52 (the terms "leading" and 'trailing" are relative to the primary direction of travel of the card 32 through the transfer station 28 during lamination of the retransfer film 20 to the surface 30), a first side edge 54 and a second side edge 56. The card 32 is longer than it is wider so that the card 32 includes a longitudinal axis L extending between the leading edge 50 and the trailing edge 52.

The surface 30 further includes a signature panel 60 upon which the end user of the card 32 is intended to sign his name. A longitudinal axis of the signature panel 60 extends substantially parallel to the longitudinal axis L of the card 32. In addition, a portion of the surface 30 can include an area 62 that is disposed directly opposite the backside of an integrated circuit chip (not shown) that is accessible from the surface 46 of the card 32. The area 62 forms a slight depression in the surface 30 located directly opposite the backside of the integrated circuit chip. In this example of the card 32, the surface 30 is typically referred to as the rear surface or the back surface, while the surface 46 is typically referred to as the front surface.

As would be understood by a person of ordinary skill in the art, the surfaces 30, 46 can include additional features such as printed text and graphics that can be applied by retransfer printing or direct-to-card printing (or combinations thereof), embossing, indent printing, a magnetic stripe, one or more holograms and/or other security features, and the like.

Figure 3:
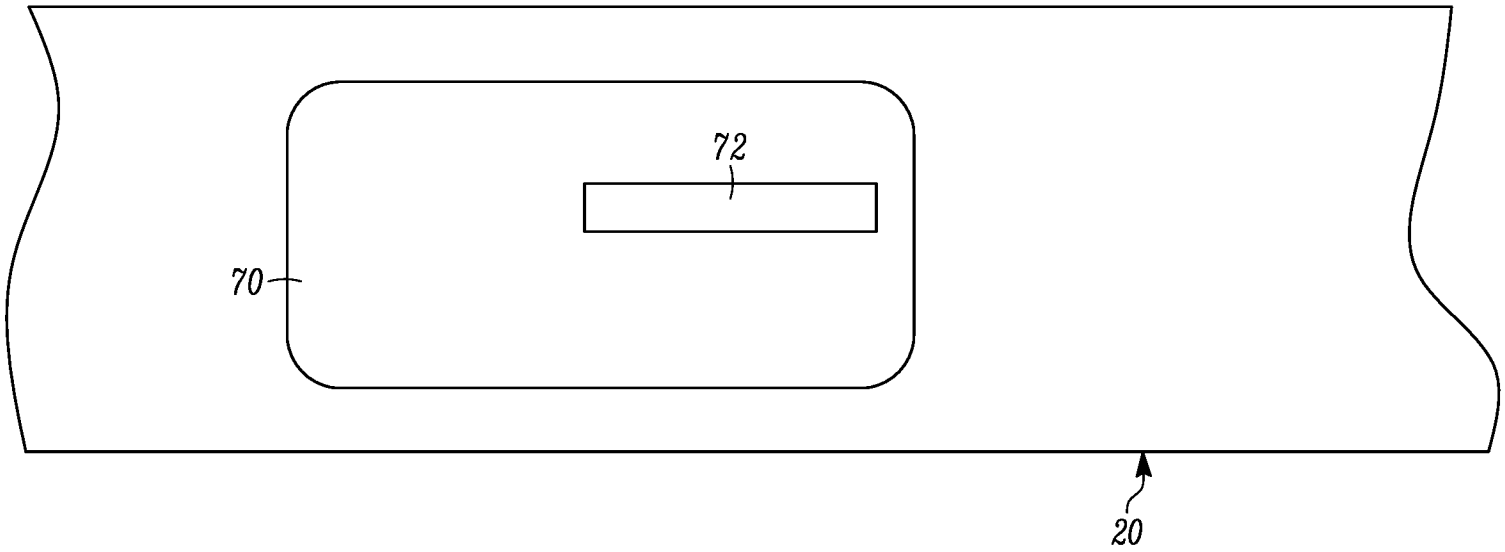
FIG. 3 is a top plan view of a section of a retransfer film having a printed image printed thereon.

FIG. 3 illustrates a section of the retransfer film 20 on which an image 70 has been printed in the print engine 10. The image 70 is intended to be transferred onto the surface 30 in order to form some or all of the printing intended to appear on the surface 30. A strip 72 of inhibitor material is provided on the image 70 at a location corresponding to the signature panel 60. The inhibitor material prevents transfer of the underlying retransfer material onto the signature panel 60. Application of the retransfer material onto the signature panel 60 can prevent or interfere with the card user signing the card. Therefore, as is known in the art, it is generally desirable to provide the strip 72 of inhibitor material to prevent application of the retransfer material to the signature panel 60.

Figure 4A:
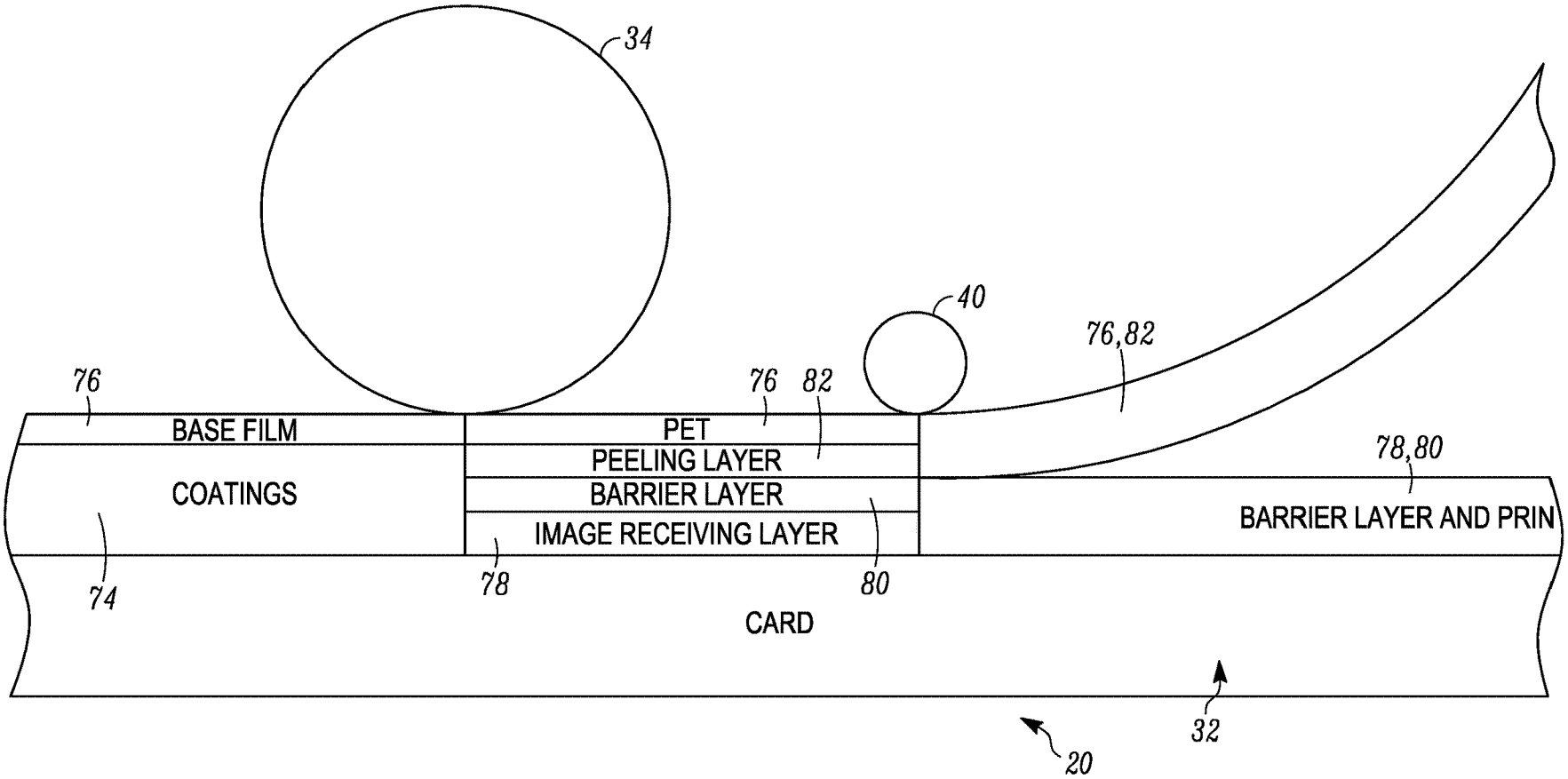
FIG. 4A is a longitudinal cross-sectional view of a portion of the retransfer film showing example components thereof and illustrating separation of a portion of the retransfer film from the remainder of the retransfer film.

FIG. 4A is a schematic longitudinal cross-sectional view of a portion of the retransfer film 20 along with the card 32 at the transfer station 28. As shown on the left side of FIG. 4A, the film 20 generally includes various coatings 74 and a base film 76. As indicated in the center portion of FIG. 4A, the coatings 74 can include, but are not limited to, an image receiving layer 78 that is receptive to receiving the dye or pigment ink from the print ribbon 14 and in/on which the printed image 70 is formed, a barrier layer 80, and a peeling layer 82 that helps the image receiving layer 78 and the barrier 80 separate from the peeling layer 82 and the base film 76 during stripping. The base film 76 can be any material suitable for carrying the coatings 74. For example, the base film 76 can be formed from polyethylene terephthalate (PET). The film 20 can include other layers that are not explicitly illustrated, such as, but not limited to, a primer layer on the image receiving layer 78 to facilitate adhesion of the image receiving layer 78 to the card surface, and other layers.

Referring to the right side of FIG. 4A, during stripping, a portion of the retransfer film 20 is stripped from the surface of the card 32 leaving behind the portion of the retransfer film 20 that contains the printed image. In particular, the base film 76 and the peeling layer 82 are stripped from the barrier layer 80 and the image receiving layer 78 and ultimately wound onto the film take-up 24 (visible in FIG. 1). The barrier layer 80 and the image receiving layer 78 (containing the printed image 70) are left behind on the card surface. The image receiving layer 78 by itself or together with the barrier layer 80 may also be referred to as a transfer layer. During stripping, a tension is applied to the base film 76 and the peeling layer 82 by the film take-up 24. For sake of convenience, the description and/or claims may refer to "tension applied to the retransfer film" during stripping which is intended to encompass applying a tension to the entire retransfer film 20 as well as a tension applied to just the base film 76 and the peeling layer 82 once the barrier layer 80 and the image receiving layer 78 are left behind on the card surface.

Figure 4B:
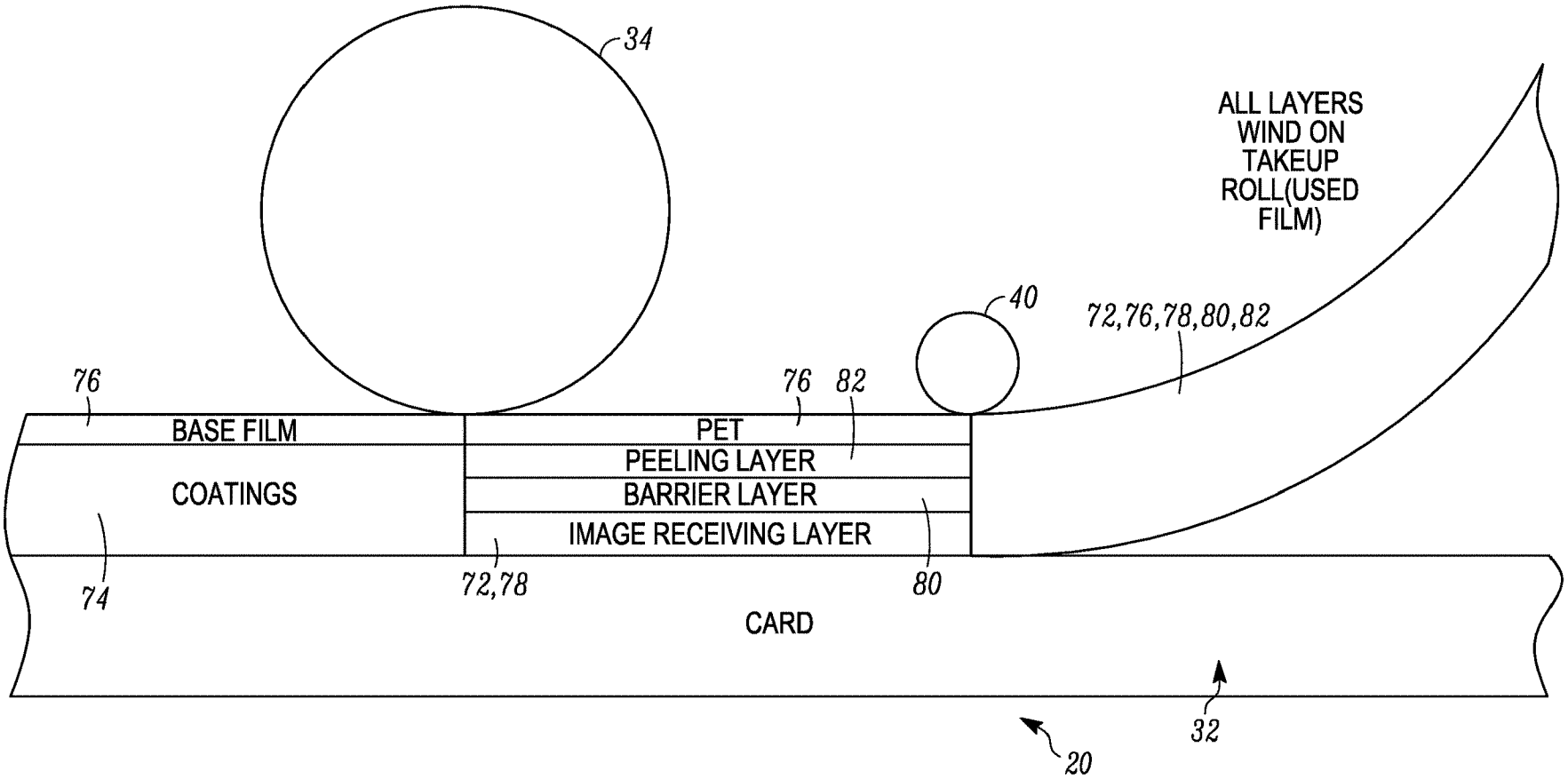
FIG. 4B is a longitudinal cross-sectional view of a portion of the retransfer film containing the inhibitor material illustrating how the inhibitor material prevents transfer of any portion of the retransfer film where the inhibitor material is located.

FIG. 4B is a schematic longitudinal cross-sectional view of a portion of the retransfer film 20 at the location of the strip 72 of inhibitor material, along with the card 32 at the transfer station 28. The construction of the retransfer film 20 is similar to the construction described in FIG. 4A, except that the strip 72 of inhibitor material is incorporated in or on the image receiving layer 78. Referring to the right side of FIG. 4B, during stripping, the inhibitor material prevents transfer of the image receiving layer 78 (and any other layers at the location of the inhibitor material) onto the card 32. Instead, the inhibitor material and all of the layers 76, 78, 80, 82 of the retransfer film 20 at the location of the inhibitor material are taken up on the film take-up 24 (visible in FIG. 1). However, other portions of the retransfer film 20 not containing the inhibitor material would be transferred onto the card surface as described above for FIG. 4A.

Returning to FIGS. 2 and 3, Applicant has discovered that improved transfer of the image 70 onto the surface 30 (or the surface 46) can be achieved by varying the stripping parameters of the film 20 from the surface 30 over the longitudinal length of the card 32. In a conventional image transfer operation, the card and the retransfer film are transported at the same speed and with a single tension applied to the retransfer film during stripping of the portion of the retransfer film from the surface over the entire longitudinal length of the card. Applicant has discovered that areas of the card surface 32, such as the signature panel 60 and the depression in the area 62, have different stripping parameters that can impact the image transfer process. For example, in order for the inhibitor strip 72 to adequately prevent transfer of the retransfer material onto the signature panel 60, during stripping the card 32 and the retransfer film 20 should be transported at a speed and/or a tension should be applied to the retransfer film 20, that differs from the transport speed and/or a tension applied to the retransfer film 20 while stripping occurs over the depression area 62.

Accordingly, in the example illustrated in FIG. 2, two zones of stripping are illustrated. Zone 1 starts from or near the leading edge 50 of the card and ends at or near the end of the signature panel 60. Zone 2 starts where zone 1 ends and continues to the trailing edge 52 of the card. In zone 1, stripping of the portion of the retransfer film 20 from the surface 32 of the card 30 at the stripping station 40 occurs while a first tension is applied to the retransfer film 20 and/or while transporting the retransfer film 20 and the card 30 at a first speed. In zone 2, stripping of the portion of the retransfer film from the surface 32 of the card 30 at the stripping station 40 occurs while a second tension is applied to the retransfer film 20 and/or while transporting the retransfer film 20 and the card 32 at a second speed. In one embodiment, stripping of the portion of the retransfer film 20 from the surface 32 of the card 30 in zone 1 occurs while the first tension is applied to the retransfer film 20 and while transporting the retransfer film 20 and the card 30 at the first speed, and stripping of the portion of the retransfer film 20 from the surface 32 of the card 30 in zone 2 occurs while the second tension is applied to the retransfer film 20 and while transporting the retransfer film 20 and the card 30 at the second speed.

The first tension differs from the second tension, and the first speed differs from the second. In one embodiment, the first tension is greater than the second tension, and the first speed is greater than the second speed.

In one embodiment, the first speed can range from about 12 mm/s to about 35 mm/s, and the second speed can range from about 6 mm/s to about 14 mm/s. In another embodiment, the first speed can be about 15 mm/s and the second speed can be about 12 mm/s. One of ordinary skill in the art will recognize that additional speed ranges could be employed depending on the desired overall machine/printer card throughput.

In one embodiment, the first tension can range from about 10 ounces to about 25 ounces, and the second tension can range from about 0 ounces to about 2.5 ounces. In some embodiments, the second tension can be less than 1 ounce, while in other embodiments the second tension can be less than 0.5 ounces or less than 0.1 ounces.

In one embodiment, the second speed can be from about 70% to about 90% of the first speed. In other embodiments, the second tension can be from about less than 1% to about 20% of the first tension. In further embodiments, the second speed can be about 80% of the first speed, while the second tension can be less than 10% of the first tension.

In an optional embodiment, the tension on the film 20 and/or the speed of transport of the card 32 and the film 20 can also be controlled prior to the leading edge 50 of the card 32 reaching the stripping station 40 (i.e. prior to beginning stripping of the portion of the film 20 from the card surface). This is illustrated in FIG. 2 as being zone 3. In zone 3, a third tension can be applied to the retransfer film 20 and/or the retransfer film 20 and the card 32 can be transported at a third speed. In zone 3, the third tension should be low or zero. In one embodiment, the tension applied to the film 20 in zone 3 should be just enough to maintain slack control in the film 20. In one embodiment, the tension applied to the film 20 in zone 3 substantially equals the tension applied to the film in zone 2, and the transport speed of the retransfer film 20 and the card 32 in zone 3 substantially equals the transport speed of the retransfer film 20 and the card 32 in zone 2.

Referring now to FIGS. 5A-C, an example progression of the card 32 and the retransfer film 20 past the transfer mechanism 34 at the transfer station 28 and past the stripping station 40 is illustrated. FIG. 5A shows the leading edge 50 of the card at the transfer mechanism 34 which is the beginning of the transfer of the printed image 70 from the retransfer film 20 onto a surface of the card 32. As the card 32 and the film 20 continue to be transported toward the stripping station 40, if zone 3 is utilized, enough tension is applied to the film 20 to maintain slack control in the film 20 and/or the card 32 and the film 20 are transported at the third speed.

In FIG. 5B, the leading edge 50 of the card 32 has now reached the stripping station 40 at which point zone 1 begins, where stripping of the portion of the retransfer film 20 from the surface 32 of the card 30 occurs while a first tension, which is greater than the tension in zone 2, is applied to the retransfer film 20 and/or while transporting the retransfer film 20 and the card 30 at a first speed which is greater than the speed in zone 2.

In FIG. 5C, the card 32 has now reached a point relative to the stripping station 40 at which point zone 2 begins, where stripping of the portion of the retransfer film 20 from the surface 32 of the card 30 occurs while a second tension, which is less than the first tension in zone 1, is applied to the retransfer film 20 and/or while transporting the retransfer film 20 and the card 30 at a second speed which is less than the first speed in zone 1. Zone 2 can continue to the trailing edge 52 of the card 32, or if different stripping parameters are required prior to reaching the trailing edge 52, a different tension and/or transport speed can be utilized once the end of zone 2 is reached.

The surface 30 may be the only surface of the card 32 that is printed on. Likewise, the surface 46 may be the only surface of the card 32 that is printed on. In embodiments where both of the surfaces 30, 46 are printed on, the surface 30 (i.e. the rear surface containing the signature panel 60) may be printed on first followed by printing on the surface 46 (i.e. the front surface). In conventional retransfer printing, the surface 46 (i.e. the front surface) is printed first followed by printing on the surface 30 (i.e. the rear surface).

In an embodiment, active cooling of the card 32 or card surface 30, 46 prior to transferring the printed image can be utilized. Cooling of the card 32 helps to improve the quality of the retransfer printing process. In some embodiments, the card can be cooled so that the temperature of the first side of the card is approximately the same as the temperature of the second side during the stripping process. Any form of active cooling that results in a reduction of the temperature of the card surface prior to transferring the image can be utilized. For example, a fan can be provided to blow a stream of air onto the card surface. An example of active card cooling that can be utilized is described in copending application Ser. No. 62/415,458 titled Card Cooling in a Card Processing Machine, the entire contents of which are incorporated herein by reference.

Referring back to FIG. 2, in one embodiment, improved transfer of the image has been achieved by bringing the printing onto a portion of the signature panel 60. FIG. 2 shows the boundaries of the signature panel 60 in solid lines. FIG. 2 shows in dashed lines an example of the perimeter size and shape of the corresponding strip 72 of inhibitor material relative to the signature panel 60. In this example, the height H of the strip 72 can be made slightly less than the corresponding height of the signature panel 60 so that a portion of the layer 78 (see FIG. 4A) that contains the printing will be transferred onto the signature panel 60 during transfer. In addition, the strip 72 can be slightly laterally offset from the signature panel 60 so that a leading portion 90 of the strip 72 will extend slightly past the leading edge of the signature panel 60, and a trailing edge 92 of the strip 72 is laterally offset from the trailing edge of the signature panel 60 so that a portion of the layer 78 (see FIG. 4A) that contains the printing will be transferred onto a trailing region 94 of the signature panel 60 during transfer.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A retransfer printing method for transferring a printed image from a retransfer film to a surface of a card, comprising:

transporting the retransfer film together with the card past a transfer mechanism at a transfer station to adhere the retransfer film containing the printed image to the surface of the card; and stripping all or a portion of the retransfer film from the surface of the card at a stripping station so that the printed image remains on the surface, wherein stripping all or a portion of the retransfer film from the surface includes:

stripping all or a portion of the retransfer film from a first portion of the surface of the card while a first tension is applied to the retransfer film and/or while transporting the retransfer film and the card at a first speed; and stripping all or a portion of the retransfer film from a second portion of the surface of the card while a second tension is applied to the retransfer film and/or while transporting the retransfer film and the card at a second speed;

wherein the first tension differs from the second tension, and the first speed differs from the second speed.

2. The retransfer printing method of claim 1, wherein the surface is a rear surface of the card, the first portion of the surface includes a signature panel, and the second portion of the surface includes a depression located opposite the backside of an integrated circuit chip.

3. The retransfer printing method of claim 2, further comprising:

after stripping all or a portion of the retransfer film from the rear surface of the card, transporting the card together with the retransfer film past the transfer mechanism at the transfer station to adhere the retransfer film containing a second printed image to a front surface of the card, and thereafter stripping all or a second portion of the retransfer film from the front surface of the card so that the second printed image remains on the front surface.

4. The retransfer printing method of claim 2, further comprising:

stripping all or a portion of the retransfer film from the first portion of the surface of the card while the first tension is applied to the retransfer film and while transporting the retransfer film and the card at the first speed; and stripping all or a portion of the retransfer film from the second portion of the surface of the card while the second tension is applied to the retransfer film and while transporting the retransfer film and the card at the second speed;

wherein the first tension is greater than the second tension, and the first speed is greater than the second speed.

5. The retransfer printing method of claim 1, wherein the second speed is from about 70% to about 90% of the first speed.

6. The retransfer printing method of claim 5, wherein the second speed is about 80% of the first speed.

7. The retransfer printing method of claim 1, wherein the second tension is less than 20% of the first tension.

8. The retransfer printing method of claim 7, wherein the second tension is less than 10% of the first tension.

9. The retransfer printing method of claim 4, further comprising:

prior to stripping all or a portion of the retransfer film from the first portion of the surface of the card, applying a third tension to the retransfer film and/or transporting the retransfer film and the card at a third speed, the third tension substantially equals the second tension and the third speed substantially equals the second speed.

10. The retransfer printing method of claim 2, comprising transferring the printed image from the retransfer film onto a portion of the signature panel.

11. A card that has been printed using the retransfer printing method of claim 1.

12. A retransfer printing method for transferring a printed image from a retransfer film to a surface of a card, comprising adhering the retransfer film containing the printed image to the surface of the card, and thereafter stripping all or a portion of the retransfer film from the surface of the card so that the printed image remains on the surface;

wherein stripping all or a portion of the retransfer film includes:

stripping all or a portion of the retransfer film from a first portion of the surface of the card while a first tension is applied to the retransfer film and/or while transporting the retransfer film and the card at a first speed; and stripping all or a portion of the retransfer film from a second portion of the surface of the card while a second tension is applied to the retransfer film and/or while transporting the retransfer film and the card at a second speed;

wherein the first tension differs from the second tension, and the first speed differs from the second speed.

13. The retransfer printing method of claim 12, wherein the surface is a rear surface of the card, the first portion of the surface includes a signature panel, and the second portion of the surface includes a depression located opposite the backside of an integrated circuit chip.

14. The retransfer printing method of claim 13, further comprising:

after stripping all or a portion of the retransfer film from the rear surface of the card, adhering the retransfer film containing a second printed image to a front surface of the card, and thereafter stripping all or a portion of the retransfer film from the front surface of the card so that the second printed image remains on the front surface.

15. The retransfer printing method of claim 13, further comprising:

stripping all or a portion of the retransfer film from the first portion of the surface of the card while the first tension is applied to the retransfer film and while transporting the retransfer film and the card at the first speed; and stripping all or a portion of the retransfer film from the second portion of the surface of the card while the second tension is applied to the retransfer film and while transporting the retransfer film and the card at the second speed;

wherein the first tension is greater than the second tension, and the first speed is greater than the second speed.

16. The retransfer printing method of claim 13, further comprising:

prior to stripping all or a portion of the retransfer film from the surface of the card, applying a third tension to the retransfer film and/or transporting the retransfer film and the card at a third speed, the third tension substantially equals the second tension and the third speed substantially equals the second speed.

17. The retransfer printing method of claim 13, comprising transferring the printed image from the retransfer film onto a portion of the signature panel.

18. A card that has been printed using the retransfer printing method of claim 12.

* * * * *